US005746161A

United States Patent [19]

Boggs

[11] Patent Number: 5,746,161

[45] Date of Patent: May 5, 1998

[54] ENGINE CYLINDER BLOCK COOLING PASSAGE

[75] Inventor: David L. Boggs, Birmingham, Mich.

[73] Assignee: Ford Motor Company, Dearborn, Mich.

[21] Appl. No.: 498,210

[22] Filed: Jul. 5, 1995

[51] Int. Cl.[6] ..... F02F 1/10

[52] U.S. Cl. ..... 123/41.72; 123/41.79

[58] Field of Search ..... 123/41.72, 41.74, 123/41.79, 41.83, 41.84

[56] References Cited

U.S. PATENT DOCUMENTS

| | | | |
|---|---|---|---|
| 742,970 | 1/1903 | Clementt | 123/41.79 |
| 1,705,390 | 6/1929 | Birkigt | 123/41.79 |
| 1,731,228 | 10/1929 | Burtnett | 123/41.72 |
| 5,115,771 | 5/1992 | Ozawa | 123/41.72 |
| 5,211,137 | 5/1993 | Kawauchi et al. | 123/41.79 |
| 5,233,947 | 8/1993 | Abe et al. | 123/41.79 |
| 5,299,538 | 4/1994 | Kennedy | 123/41.79 |

FOREIGN PATENT DOCUMENTS

| | | | |
|---|---|---|---|
| 27 25 059 | 12/1978 | Germany . | |
| 531216 | 7/1955 | Italy | 123/41.74 |
| 2556606 | 7/1926 | United Kingdom | 123/41.84 |

OTHER PUBLICATIONS

SAE Paper 931123 "Precision Cooling of a Four Valve Per Cylinder Engine" M. J. Clouth/Jaguar Cars.

*Primary Examiner*—Noah P. Kamen
*Attorney, Agent, or Firm*—Donald A. Wilkinson

[57] ABSTRACT

A cylinder block (10) of an internal combustion engine (12) includes a cylinder bore (14). The cylinder bore (14) has a cooling passage (18) surrounding it that extends along the cylinder bore (14) for a substantial portion of a piston stroke. The cooling passage (18) near the top of the block (28) is wider than at the bottom of the passage (18). The lower portion of the passage (18) tapers sufficiently that viscous drag affects the velocity within the coolant passage (18), the velocity varying in a direction normal to the general direction of coolant flow.

15 Claims, 2 Drawing Sheets

ENGINE CYLINDER BLOCK COOLING PASSAGE

FIELD OF THE INVENTION

The present invention relates to an engine having cooling passages extending around its engine cylinders within the cylinder block.

BACKGROUND OF THE INVENTION

Generally, engine cylinder blocks are cooled by a liquid coolant, in a coolant passage, or jacket, that extends from the top or near the top of the cylinder block down roughly as far as the piston travels (100 percent piston stroke), and surrounds each of the cylinders. The coolant jackets are generally uniform in cross-section, given allowances for the taper required for casting or other manufacturing purposes. The uniform cross-section results in a uniform heat transfer coefficient from the cylinder to the coolant. But, because the heat flux from an engine cylinder is much lower at the bottom of the cylinder than at the top, while each of the cylinder walls is adequately cooled at the top of the bore the bottom of each of the cylinders in an engine is over-cooled.

Overcooling is undesirable because the cylinder wall will not have a uniform temperature from top to bottom. A uniform wall temperature has several advantages, such as reduced cylinder bore distortion for better sealing and reduced wear, lower hydrocarbon (HC) emissions, and reduced fuel consumption of the engine. In recognition of the overcooling concern, state-of-the-art engine designs have reduced the depth of the coolant jacket to less than 100 percent of the piston stroke, i.e., the coolant jacket does not extend down in the block as far down as the piston travels. This will raise the temperature in the lower part of the block, but the remaining coolant jacket still has a uniform cross-section, which yields a uniform heat transfer coefficient and a non-uniform wall temperature profile, thus, not totally eliminating the concern.

Some prior art designs have had tapered coolant jackets, but they are generally for manufacturing reasons, and they do not match the tapers to closely control the heat transfer to maintain a uniform cylinder wall temperature.

Consequently, it is desired to have a coolant jacket design with a heat transfer coefficient matched to the heat flux level in order to maintain a uniform cylinder wall temperature. For this, an engine cylinder block cooling passage design is needed which matches the convective heat transfer coefficient to the heat flux from the combustion gases, thereby yielding a uniform cylinder wall temperature.

One type of design, which attempts to overcome this concern, is disclosed in U.S. Pat. 5,233,947 to Abe et al., and U.S. Pat. No. 5,211,137 to Kawauchi et al. They employ stepped velocity (discrete steps) to adjust heat transfer in series of circumferential passages that encircle each cylinder. These patents recognize the desire for reduced coolant velocity at the bottom of the cylinder and achieve it by having lower velocity coolant flow achieved in the lower grooves by virtue of a higher pressure drop along the inlet and/or outlet coolant manifolds. The grooves near the top of the cylinder are fed from the manifolds the top where they are large and not much pressure drop occurs. The grooves near the bottom of the cylinder, however, are fed from the bottom of the manifolds where the manifolds are narrower and create a pressure drop along the flow path. These patents, then, disclose distributing the flow along the cylinder axis by varying the pressure drop for each of the many flow passages relative to one another, from top to bottom.

The pressure drop occurs along, or parallel to the flow direction. The only way to increase its accuracy is to keep increasing the number of passages since the flow change is discrete from one passage to the next, resulting in a design with many flow passages to maintain accuracy.

SUMMARY OF THE INVENTION

In its embodiments, the present invention contemplates an internal combustion engine. The engine comprises a piston and a cylinder block. The cylinder block has an upper end and a lower end and includes a cylindrical bore in the cylinder block extending from the upper to the lower end forming a piston cylinder for slidably receiving the piston therein. The cylinder block further includes a coolant jacket encircling the cylinder, adapted for receiving coolant fluid to flow therein, with the coolant jacket tapering sufficiently in width such that the velocity of fluid flowing within the coolant jacket will vary in a direction normal to the general direction of fluid flow due to a viscous drag effect acting on fluid over a portion of the length of the cooling jacket, wherein the heat transfer coefficient will be reduced with reduced velocity of fluid.

Accordingly, an object of the present invention is to create a coolant jacket with variable cross-sectional area so that the heat transfer coefficient profile substantially matches the heat, flux profile, and therefore results in a uniform wall temperature profile, by varying, in a direction normal to the flow, the velocity of the fluid within the coolant jacket.

An advantage of the present invention is that it avoids cylinder blocks being adequately cooled at the top of the bore while being over-cooled at the bottom by matching the heat transfer coefficient to the heat flux from combustion in the cylinder (i.e., matching the heat transfer coefficient to the heat flux to provide adequate cooling over the whole length of the cylinder); this gives a uniform cylinder block temperature profile that reduces bore distortion for better sealing (reduces blowby of combustion gases past the piston rings) and reduced piston and cylinder liner wear, lowers HC emissions, and reduces fuel consumption of the engine.

Another advantage of the present invention is that the cylinder wall temperature can be maintained uniformly, with minimal discrete steps without having to add a large number of circumferential passages around each cylinder.

DETAILED DESCRIPTION OF THE PREFERRED EMBODIMENTS

Figure 1:
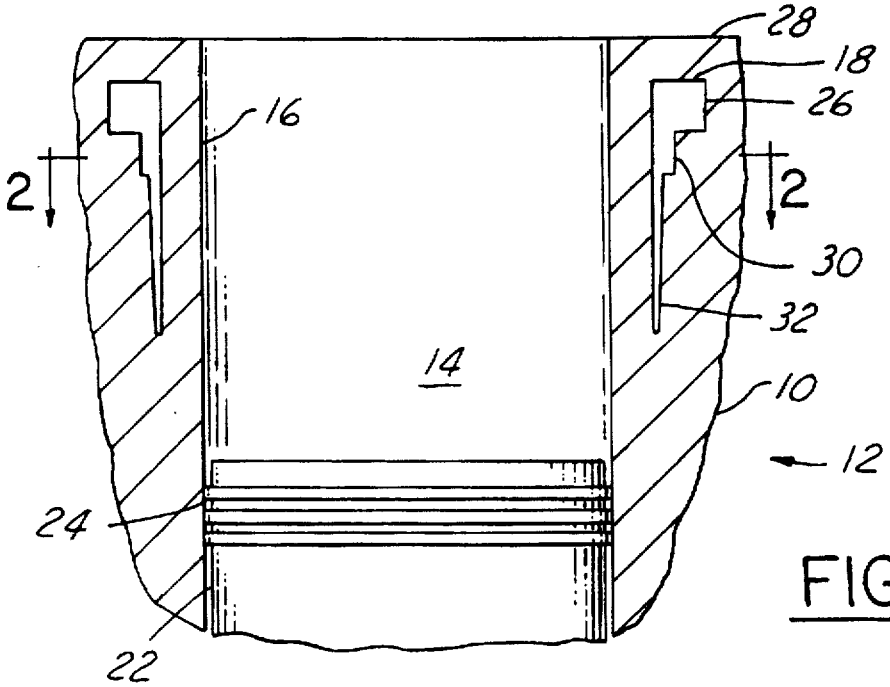
FIG. 1 is a side sectional view of a cylinder in an engine block and the cooling passage running about the cylinder.

This invention disclosure concerns the design of a coolant passage which matches the convective heat transfer coefficient of the coolant flow to the heat flux rejected from the combustion gases in the cylinder. By matching the heat transfer coefficient and the heat flux, it is possible to achieve a substantially uniform temperature profile on a cylinder wall.

A cylinder block 10 of an engine 12 includes cylinder bores 14. The cylinder bores 14 are defined by cylinder walls 16. Surrounding a portion of each cylinder wall 6, within the cylinder block 10, is a cooling passage, or jacket, 18. A liquid coolant fills the cooling passage 18 and generally flows while the engine is operating above a predetermined temperature. The arrows in FIG. 2, labeled as element 20, show the general flow of coolant through the cooling passage, forming a flow stream. Each cylinder bore 14 receives a piston 22, which slides up and down in a reciprocating motion. Each piston has piston rings 24 mounted thereto to provide for sealing between the piston 22 and its respective cylinder wall 16.

The cooling passage 18 around each cylinder wall 16 includes a first section 26 near the top of the block 28, a second section 30 adjacent to the first and a third section 32 adjacent to the second 30. The first section 26 is wider than the second section 30 with a step change in width between the two.

The second section 30 is wider than the third 32 with a step change between the two. The third section 32 tapers down in width from top to bottom.

The widths of the third section 32 and the second section 30 are sized such that as coolant flows in the cooling passage 18, a viscous drag effect on the walls of these sections will cause the fluid in these sections 30, 32 to travel more slowly than in the first section 26. This difference in velocity of the fluid varies the amount of heat absorbed. The reasons for this difference in heat absorption will now be described.

Generally, the heat flux to the coolant of an engine is commonly expressed as $q''(y)=h(y)(T_{wall}(y)-T_{coolant})$. The term $q''(y)$ is the beat flux or heat flow per unit area at location y, where y is the direction of the piston stroke within the cylinder; $h(y)$ is the convective heat transfer coefficient at location y; $T_{wall}(y)$ is the temperature of the wall at location y; and $T_{coolant}$ is the temperature of the coolant. The coolant temperature is considered to be a constant in the y direction, although it may change along the z direction (along the flow stream). If $h(y)$ has the same shape as $q''(y)$, then $T_{wall}(y)$ will be constant. Another equation needed to understand the present invention is that the heat transfer coefficient is affected by the fluid velocity. This is expressed by $h \propto v^{0.8}$; where $\alpha$is the average velocity of the fluid. This relation is valid for turbulent flows in a passage, which is generally the case in engine coolant flows. Therefore, the heat transfer coefficient is shaped by shaping the velocity profile of the fluid in the cooling passage 18, but not on a one-to-one basis.

The phenomenon which is used here to tailor the velocity profile of the coolant in the cooling passage 18 is that of viscous drag. That is, a boundary layer effect is used to influence and vary the velocities within the cooling passage 18. In a boundary layer, the fluid slows down until, at a solid surface, the velocity is zero. The boundary layer effect occurs because of viscous drag in the fluid. In order to obtain a velocity variation along the y-direction in the cooling passage 18, the coolant jacket width must be such that the average velocity of the fluid is significantly effected by the boundary layer at the appropriate locations in the passage 18.

This means that coolant jackets which are significantly wider than the boundary layer will not demonstrate the effect of velocity profile shaping due to a viscous drag effect. Thus, simply tapering the passage will not reduce the velocity enough to have any substantial effect. The cross-section of the coolant passage must by reduced enough so that viscous drag can substantially slow down the flow at the correct locations in the cooling passage 18. The passage should be thin enough at the thinnest section for the boundary layer of the liquid flow to affect the average velocity at those locations. Typically, boundary layers in turbulent, fully-developed flow are around 1 mm thick, so when the passage thickness gets above approximately 4 mm, the mean velocity is not significantly affected anymore.

Figure 3:
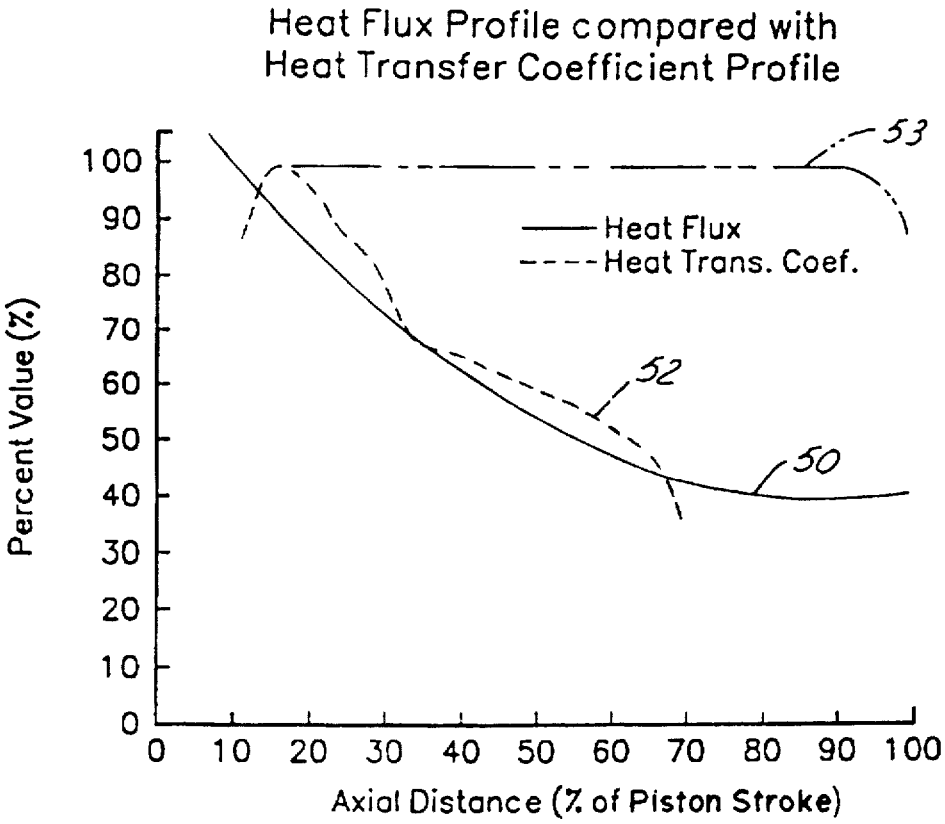
FIG. 3 is a graph of a heat flux profile compared with a heat transfer coefficient profile.

An example of the requisite dimensions will now be discussed. FIG. 3 illustrates a graph of a heat flux profile 50 compared with a heat transfer coefficient profile 52 from a flow simulation which approximates the velocities. The axial distance (% of stroke) is the y-direction of the above noted equations starting from the top of the block 28 and extending to the downward limit of the stroke of the piston 22. FIG. 3 also shows the heat transfer coefficient 53 from a conventional coolant jacket design having a constant width and extending 100 percent of the piston stroke.

Figure 2:
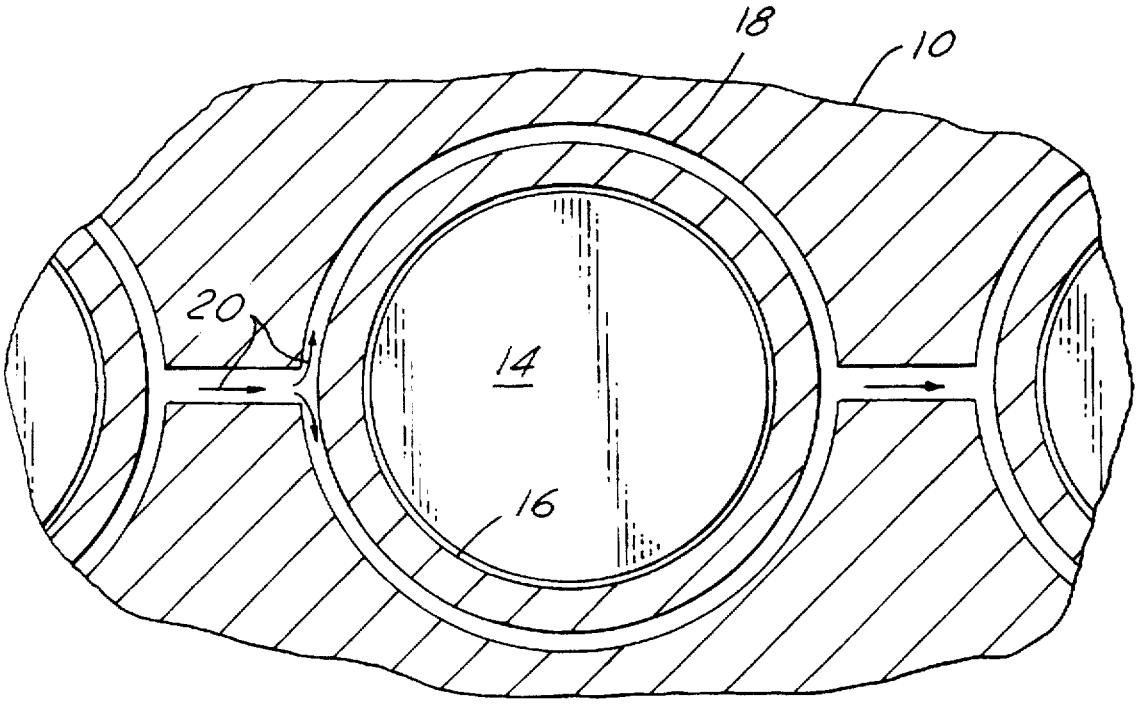
FIG. 2 is a section cut taken along line 2—2 in FIG. 1, rotated 90 degrees.

The dimensions for this example will be with reference to FIGS. 1 and 2. The first section 26 has a width of ten millimeters (mm) and extends from about ten percent to twenty three percent of the piston stroke. The second section 30 has a width of four mm and extends from about twenty three percent to thirty three percent of the piston stroke. The third section 32 tapers from two mm, where it intersects the second section 30, to one mm and extends from about thirty three percent to seventy percent of the piston stroke. As can be noted, the dimensions at the third section 32 are thin enough for a boundary layer to significantly affect the average velocity at those locations, and the dimensions of the second section 30 are enough for a boundary layer to have a minor effect on the velocity. As can be seen from FIG. 3, these dimensions allow for the heat transfer coefficient 52 to closely track the heat flux 50, thereby maintaining a more uniform temperature in cylinder wall 16. More steps can be used to form cooling passage 18, if so desired, in order to more closely match the heat flux profile with the heat transfer coefficient profile.

In the exemplary cylinder block illustrated in FIGS. 1 and 2, the cooling passage 18 does not extend all of the way to the top of the cylinder block 10. This is because the cylinder block 10 is a closed deck design, which requires a continuous wall across the top of the block 28. The present invention, however, is also applicable to cylinder block designs known as open deck. For this type of cylinder block design, then, the cooling passage can extend all of the way to the top of the block, which would allow for a better matching of the heat flux profile to the heat transfer coefficient profile at zero to ten percent of the piston stroke.

Figure 4:
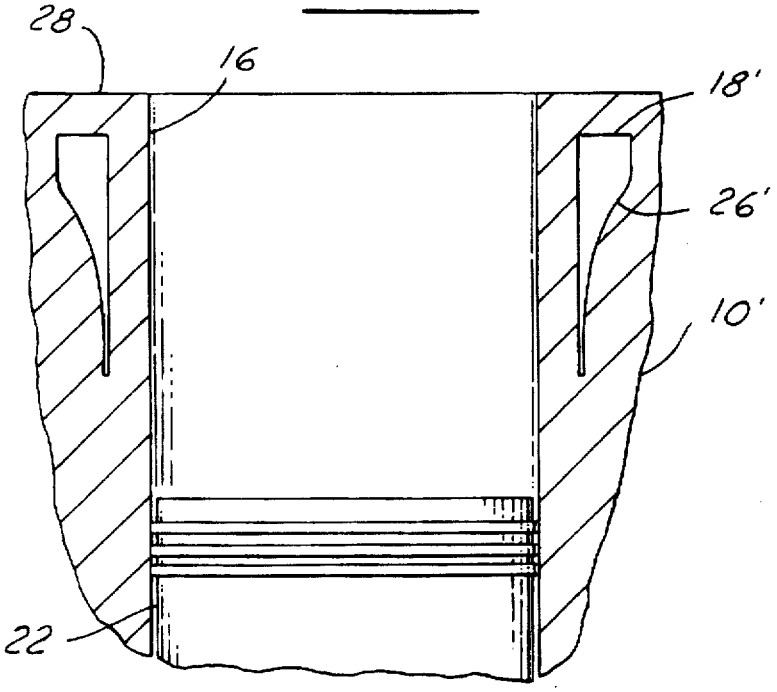
FIG. 4 is a side sectional view similar to FIG. 1 showing an alternate embodiment of the present invention.

FIG. 4 shows an alternate embodiment of the present invention. In this embodiment, similar elements are similarly designated with the first embodiment, while changed elements are designated with an added prime. The cooling jacket 18' in the cylinder block 10' has one section 26' that tapers from top to bottom rather than having discrete steps in width. The taper allows for more precise control of the amount of cooling at each vertical location in the cylinder wall 16. It is preferable to taper the width of the cooling passage 18' rather than step as far as maintaining as much accuracy as possible for matching the heat flux profile to the heat transfer coefficient profile, although this configuration may be more expensive to fabricate than a cooling passage with discrete steps. The taper in the width of the cooling passage 18' is non-linear to more completely match the heat transfer coefficient to the heat flux curve.

While certain embodiments of the present invention have been described in detail, those familiar with the art to which this invention relates will recognize various alternative designs and embodiments for practicing the invention as defined by the following claims.

I claim:

1. An internal combustion engine comprising:

a piston; and a cylinder block having an upper end and a lower end and including a cylindrical bore in the cylinder block extending from the upper to the lower end forming a piston cylinder for slidably receiving the piston therein, and a coolant jacket encircling the cylinder, adapted for receiving coolant fluid to flow therein in a circumferential flow direction around the piston cylinder, with the coolant jacket tapering non-linearly from top down sufficiently in width such that the velocity of fluid flowing within the coolant jacket will vary in a direction normal to the general direction of fluid flow due to a viscous drag effect acting on fluid over a portion of the length of the cooling jacket, wherein the heat transfer will be reduced with reduced velocity of fluid.

2. The internal combustion engine of claim 1 wherein the coolant jacket includes two sections, a first section and a second section adjacent to the first section, with the second section having a width smaller than the first section and sufficiently narrow to cause a viscous drag effect on the average velocity of fluid flowing within the second section.

3. The internal combustion engine of claim 1 wherein the coolant jacket includes three sections, a first section, a second section adjacent to the first section, and a third section adjacent to the second section, with the second section having a width smaller than the first section and sufficiently narrow to cause a viscous drag effect on the average velocity of fluid flowing within the second section, and the third section having a width smaller than the second section and sufficiently narrow to cause a greater viscous drag effect on the average velocity of fluid flowing within the third section than fluid flowing in the second section.

4. The internal combustion engine of claim 3 wherein the first section has a width of ten millimeters, the second section has a width of four millimeters and the third section tapers from 2 millimeters width adjacent to the second section to 1 millimeter at is other end.

5. The internal combustion engine of claim 1 wherein the piston slides within the cylinder bore a predetermined distance and the coolant jacket extends over only seventy percent of the distance.

6. The internal combustion engine of claim 5 wherein the width of the coolant jacket near the upper end of the cylinder block is ten millimeters and the width of the coolant jacket near the lower end of the cylinder block is one millimeter.

7. The internal combustion engine of claim 1 wherein the piston slides within the cylinder bore a predetermined distance and the coolant jacket extends over between 60 and 80 percent of the distance.

8. An internal combustion engine comprising:

a piston; and a cylinder block having an upper end and a lower end and including a cylindrical bore in the cylinder block extending from the upper to the lower end forming a piston cylinder for slidably receiving the piston therein, and a coolant jacket encircling the cylinder, adapted for receiving coolant fluid to flow therein in a circumferential flow direction around the piston cylinder, with the coolant jacket tapering from top down non-linearly from one end to the other sufficiently in width such that the velocity of fluid flowing within the coolant jacket will vary in a direction normal to the general direction of fluid flow due to a viscous drag effect acting on fluid over a portion of the length of the cooling jacket, wherein the heat transfer will be reduced with reduced velocity of fluid; and the piston is slidable within the cylinder bore a predetermined distance, with the coolant jacket extending over between 60 and 80 percent of the distance.

9. A method of cooling a cylinder wall of a cylinder bore within a cylinder block of an internal combustion engine comprising the steps of:

providing coolant fluid;

providing a cooling passage within the cylinder block about the cylinder wall that tapers non-linearly from top down sufficiently in width such that the velocity of any fluid that flows in a circumferential flow direction around the cylinder wall within the coolant jacket will vary in a direction normal to the direction of flow;

receiving the fluid in the cooling passage;

operating the engine; and flowing fluid through the cooling passage as the engine operates.

10. An internal combustion engine comprising:

a piston; and a cylinder block having an upper end and a lower end and including a cylindrical bore in the cylinder block extending from the upper to the lower end forming a piston cylinder for slidably receiving the piston therein, and a coolant jacket encircling the cylinder, adapted for receiving coolant fluid to flow therein, with the coolant jacket tapering sufficiently in width such that the velocity of fluid flowing within the coolant jacket will vary in a direction normal to the general direction of fluid flow due to a viscous drag effect acting on fluid over a portion of the length of the cooling jacket, wherein the heat transfer will be reduced with reduced velocity of fluid, with the coolant jacket including three sections, a first section having a width of about ten millimeters, a second section adjacent to the first section having a width of about four millimeters, and a third section adjacent to the second section having a taper from about two millimeters width adjacent to the second section to one millimeter at its other end.

11. An internal combustion engine comprising:

a piston; and a cylinder block having an upper end and a lower end and including a cylindrical bore in the cylinder block extending from the upper to the lower end forming a piston cylinder for slidably receiving the piston therein, with the piston slidable within the cylinder bore a predetermined distance, and a coolant jacket, encircling the cylinder and extending over only seventy percent of the predetermined distance, adapted for receiving coolant fluid to flow therein, with the coolant jacket tapering non-linearly from one end to the other sufficiently in width such that the velocity of fluid flowing within the coolant jacket will vary in a direction normal to the general direction of fluid flow due to a viscous drag effect acting on fluid over a portion of the length of the cooling jacket, wherein the heat transfer will be reduced with reduced velocity of fluid.

12. The internal combustion engine of claim 11 wherein the width of the coolant jacket near the upper end of the cylinder block is ten millimeters and the width of the coolant jacket near the lower end of the cylinder block is one millimeter.

13. An internal combustion engine comprising:

a piston; and a cylinder block having an upper end and a lower end and including a cylindrical bore in the cylinder block extending from the upper to the lower end forming a piston cylinder for slidably receiving the piston therein, and a coolant jacket encircling the cylinder, adapted for receiving coolant fluid to flow therein in a circumferential flow direction around the piston cylinder, with the coolant jacket having an upper portion which has a width that is generally wider than 4 millimeters and a lower portion that has a width that is narrower than 4 millimeters, with a stepped reduction in width between the under and lower portions, such that the velocity of fluid flowing within the coolant jacket will vary in a direction normal to the general direction of fluid flow due to a viscous drag effect acting on fluid over the lower portion of the cooling jacket.

14. The internal combustion engine of claim 13 wherein the coolant jacket includes a middle portion which has a width that is between 2 and 4 millimeters, with the middle portion width being greater than the width of the lower portion.

15. The internal combustion engine of claim 13 wherein the lower portion of the coolant jacket tapers from about 2 millimeters at the end adjacent the upper portion to about 1 millimeter.

* * * * *